US007083456B2

(12) United States Patent
Trout et al.

(10) Patent No.: US 7,083,456 B2
(45) Date of Patent: Aug. 1, 2006

(54) ELECTRICAL CONNECTOR SOCKET WITH LOADING CADDY

(75) Inventors: David Allison Trout, Lancaster, PA (US); Attalee Snarr Taylor, Palmyra, PA (US); Richard Nicholas Whyne, Camp Hill, PA (US); Matthew R. McAlonis, Elizabethtown, PA (US); Darrell Lynn Wertz, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/005,984

(22) Filed: Dec. 7, 2004

(65) Prior Publication Data

US 2005/0208813 A1 Sep. 22, 2005

Related U.S. Application Data

(60) Provisional application No. 60/554,016, filed on Mar. 17, 2004.

(51) Int. Cl.
*H01R 13/62* (2006.01)

(52) U.S. Cl. ..... 439/326; 439/331

(58) Field of Classification Search ..... 439/326, 439/331, 341, 342, 376
See application file for complete search history.

(56) References Cited

U.S. PATENT DOCUMENTS

| | | | | |
|---|---|---|---|---|
| 5,344,334 | A | 9/1994 | Laub et al. | 439/331 |
| 5,602,719 | A * | 2/1997 | Kinion | 361/704 |
| 5,657,081 | A * | 8/1997 | Kurahashi | 348/231.7 |
| 5,961,338 | A * | 10/1999 | Wu et al. | 439/326 |
| 6,106,317 | A * | 8/2000 | Michaelis et al. | 439/326 |
| 6,485,320 | B1 | 11/2002 | Ma | 439/342 |
| 6,699,057 | B1 | 3/2004 | Ma | 439/342 |
| 2004/0067673 | A1 * | 4/2004 | Matsunaga et al. | 439/331 |

* cited by examiner

*Primary Examiner*—Tho D. Ta

(57) ABSTRACT

A socket connector for an electronic package includes a socket housing and a loading caddy having a forward end and a rearward end. The forward end includes an opening dimensioned to receive the electronic package. The loading caddy is coupled to the housing for linear and rotational movement therewith. The loading caddy rotates through a first range of motion adapted to align the electronic package with respect to the housing, and descends linearly through a second range of motion to load the electronic package into the housing.

21 Claims, 13 Drawing Sheets

ELECTRICAL CONNECTOR SOCKET WITH LOADING CADDY

CROSS REFERENCE TO RELATED APPLICATIONS

This application claims the benefit of U.S. provisional application No. 60/554,016 filed Mar. 17, 2004.

BACKGROUND OF THE INVENTION

The invention relates generally to socket connectors and particularly to a socket connector with a component loading caddy.

Competition and market demands have continued the trends toward faster, higher performance electrical systems, particularly with regard to computer systems. Along with the development of surface mount technology in the design of printed circuit boards, higher density electrical circuits, electronic packages such as chip carrying modules that are to be mounted to a circuit board, and higher density interconnect components have been developed to meet the increasing demand for higher performance electrical systems. Surface mount packaging allows for the connection of electronic packages to contact pads on circuit boards rather than with contacts or pins soldered to plated holes extending through circuit boards. Surface mount technology allows for an increased component density on a circuit board, thereby saving space on the circuit board.

Area array socket connectors have evolved, along with surface mount technology, as one high density interconnect technique for integrated circuits. One application of this technology, for example, is the land grid array (LGA) socket connector that is used with an LGA package. The LGA package is durable and is not easily damaged during the installation or removal process or by handling generally. At least some of the other integrated circuit packages, such as a pin grid array (PGA) package, have a standardized layout, or form factor, for contact leads or pins on the package. The contact leads in such packages are fragile and, unlike the LGA package, can be damaged if not handled properly.

While the LGA package is durable, known LGA sockets can be problematic. In at least some LGA sockets, when the socket is opened, the electrical contacts, sometimes referred to as contact beams, are exposed and the LGA package is loaded directly on top of the contact beams. The LGA socket is designed for loading and unloading of the package in a vertical direction, i.e. a direction normal, or perpendicular to the circuit board, and consequently a socket cover, or load plate, or other actuation component typically has at least a ninety degree range of movement to prevent interference or obstruction of a load path for the package. Movement of actuation components away from the load path exposes the flexible surface mount contact beams in the socket, rendering the beams susceptible to damage during loading and unloading of the package. The beams may be broken, bent, or otherwise deformed thereby resulting in misalignment of the contact beams with respect to the package.

BRIEF DESCRIPTION OF THE INVENTION

In one aspect, a socket connector for an electronic package is provided that includes a socket housing and a loading caddy having a forward end and a rearward end. The forward end includes an opening dimensioned to receive the electronic package. The loading caddy is coupled to the housing for linear and rotational movement therewith. The loading caddy rotates through a first range of motion adapted to align the electronic package with respect to the housing, and descends linearly through a second range of motion to load the electronic package into the housing.

Optionally, the housing includes a stepped recess and the loading caddy includes a stepped tab. The stepped tab is received in the stepped recess to couple the loading caddy to the housing. The tab is movable through the first and second ranges of motion within the stepped recess. A load plate is rotatably coupled to the housing. The load plate is configured to apply a load to the electronic package. A heat sink post extends through an aperture in the load plate. The heat sink post is positioned to limit a range of rotation of the load plate.

In another aspect, a socket connector for an electronic package is provided. The connector includes a housing that includes a stepped recess. A loading caddy is coupled to the housing and movable between an open position and a closed position. The loading caddy is configured to receive an electronic package when in the open position and load the electronic package into the housing when moved to the closed position. The loading caddy includes a stepped tab that is received in the stepped recess to couple the loading caddy onto the housing. The tab is configured to engage a surface of the recess to limit a range of rotational movement of the loading caddy.

In yet another embodiment, a socket connector for an electronic package is provided that includes a housing, an electronic package, and a loading caddy. The loading caddy has a forward end and a rearward end. The forward end includes an opening dimensioned to receive the electronic package. The loading caddy is coupled to the housing for linear and rotational movement therewith. The loading caddy rotates through a first range of motion adapted to align the electronic package with respect to the housing, and descends linearly through a second range of motion to load the electronic package into the housing.

DETAILED DESCRIPTION OF THE INVENTION

Figure 1:
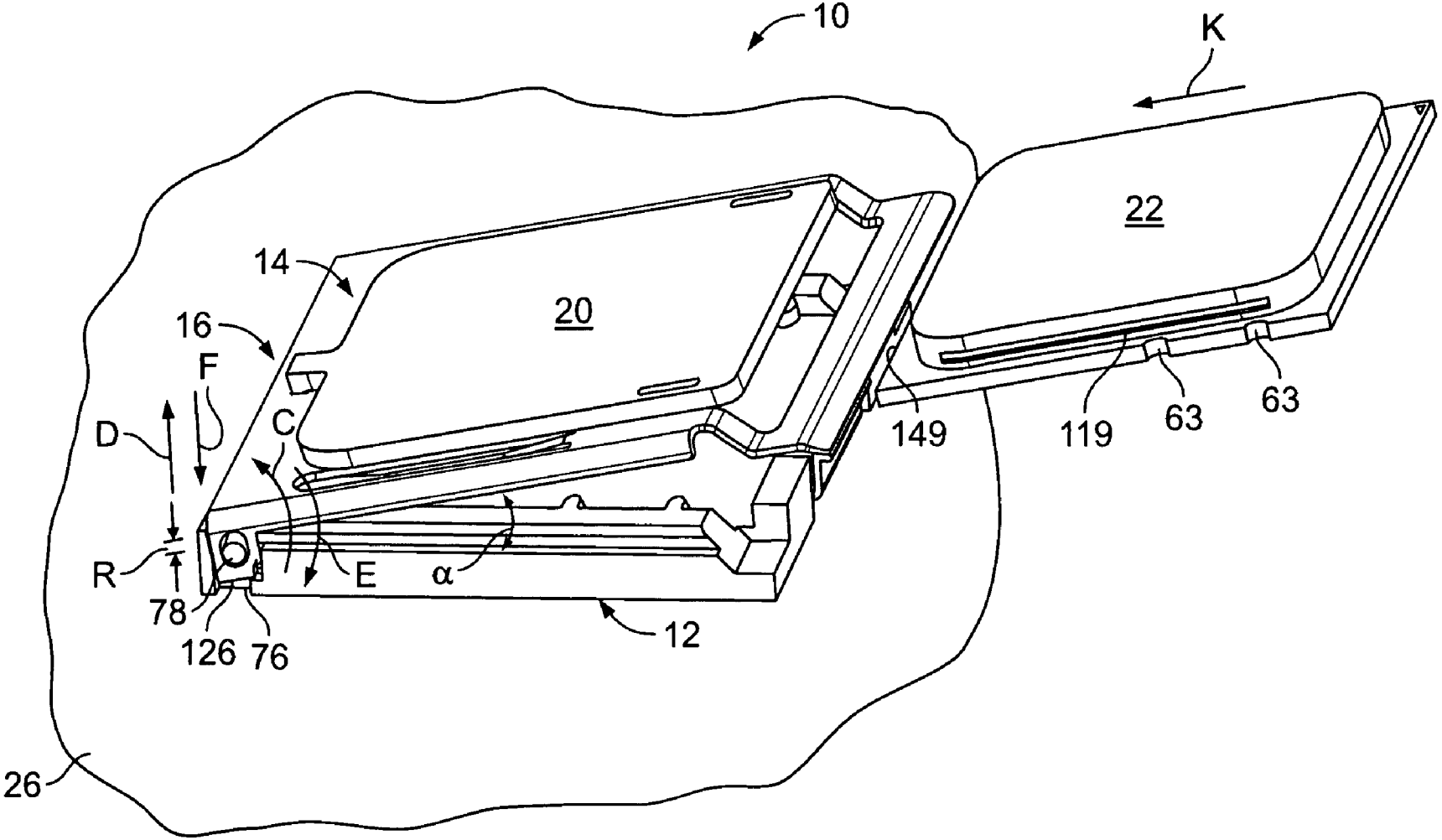
FIG. 1 is a perspective view of a socket connector formed in accordance with an exemplary embodiment of the present invention, shown with a pick and place cover and a processor module.

FIG. 1 is a perspective view of a socket connector 10 formed in accordance with an exemplary embodiment of the present invention. The connector 10 includes a housing 12 and a loading caddy 14 that is coupled to the housing 12 at a rearward end 16. In FIG. 1, the connector 10 is shown with a pick and place cover 20 attached to the loading caddy 14. An electronic package 22, which in the exemplary embodiment is a land grid array (LGA) module, is receivable in the loading caddy 14, and displaces the pick and place cover 20 as described below. The connector 10 may be mounted to a circuit board 26 that may be used, among other applications, in a personal computer or in a server application. The connector 10 can be used to mount a central processing unit (CPU) or other chip carrying module to the circuit board 26. While the connector 10 will be described with particular reference to a particular electronic package in the form of a land grid array (LGA) module, it is to be understood that other electronic packages and modules may likewise be employed in alternative embodiments.

Figure 2:
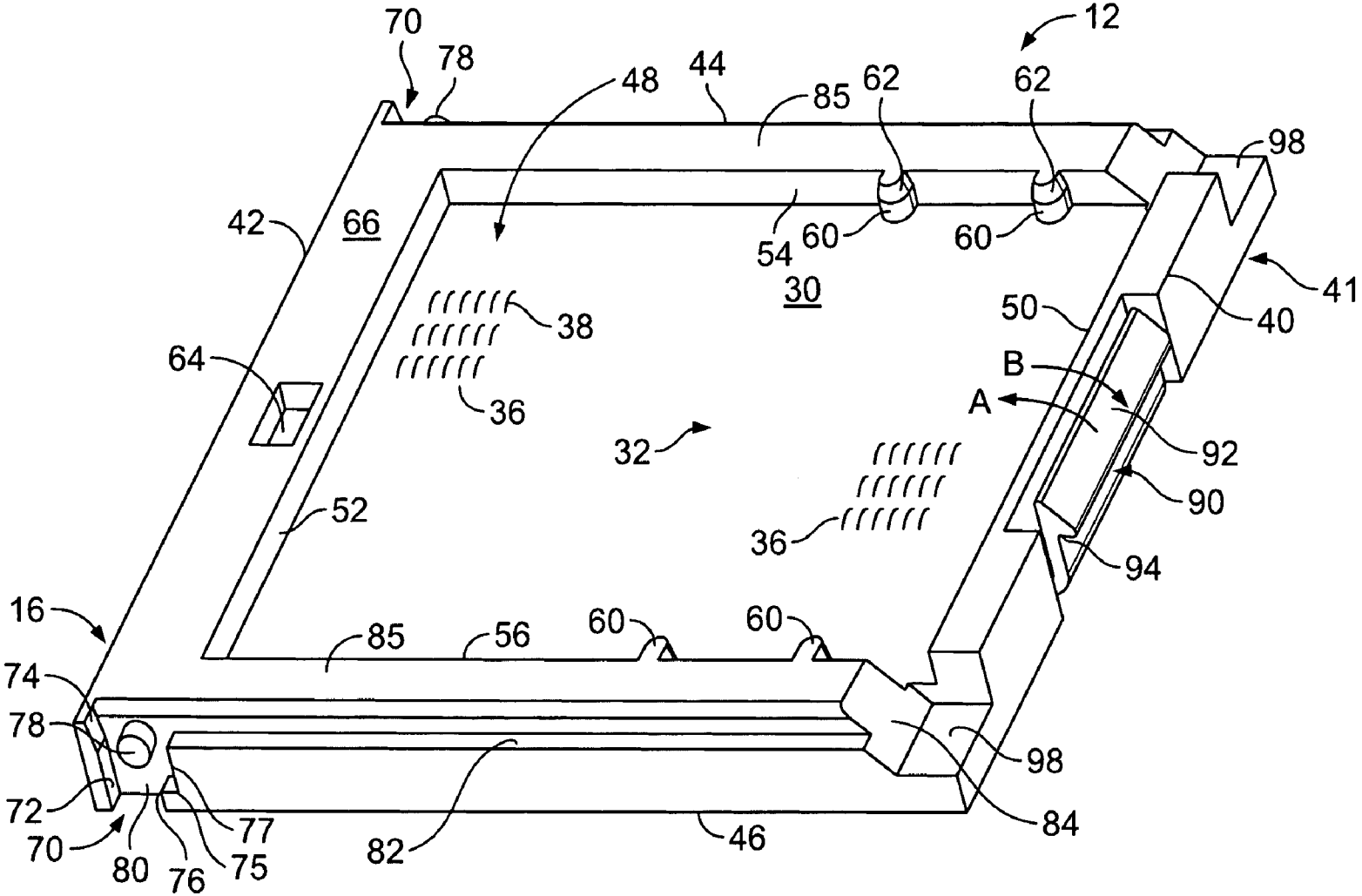
FIG. 2 is a perspective view of the housing of the connector shown in FIG. 1.

FIG. 2 illustrates a perspective view of the housing 12. The housing 12 includes a base 30 which is fabricated from a dielectric material and defines a contact field 32 that includes an array 36 of individual electrical contacts 38. The housing 12 is substantially rectangular in shape, although other geometric forms and shapes may be employed in alternative embodiments. The housing 12 includes a front end section 40, at a forward end 41, a rear end section 42 at rearward end 16, and side sections 44 and 46. The end and side sections 40, 42, 44, and 46 extend above the base 30 to define an enclosure 48 surrounded by interior walls 50, 52, 54, and 56. The enclosure 48 receives the electronic package 22 (shown in FIG. 1) for placement on the contact field 32 when the package 22 is loaded into the socket housing 12. Each side section 44 and 46 includes keys 60 that assure that the package 22 is properly oriented and aligned axially with respect to the housing 12. Each key 60 includes a beveled guide surface 62 to guide the package 22 into the housing 12. Corresponding key slots 63 (FIG. 1) are provided on the package 22.

The rear end section 42 includes a centrally located recess 64 in an upper surface 66 that provides a clearance for the pick and place cover 20 (FIG. 1). Mounting recesses 70 are provided in each side section 44 and 46 proximate the rear end section 42 for attachment of the loading caddy 14 (FIG. 1) to the housing 12. Each recess 70 contains a rearward surface 72 that is substantially vertical and a beveled surface 74 that extends to the upper surface 66. Each recess 70 also includes a stepped cutout 75 that includes a step 76 formed in the recess 70 opposite the surface 72. A pivot post 78 extends outwardly from a base surface 80 of the recess 70 and into the recess 70. A ledge 82 extends along each side section 44 and 46 from the recess 70 to a slanted forward surface 84 that extends to upper surfaces 85 on each side section 44 and 46.

The front end section 40 includes a latch element 90 that engages the loading caddy 14 to hold the loading caddy 14 in a closed position as will be described. The latch element 90 includes a beveled engagement surface 92 and a latching surface 94. The latch element 90 is pivotable in the directions of arrows A and B to latch and release the loading caddy 14, with the latch element 90 being biased in the direction of arrow B. The front end section 40 also includes relief cutouts 98 which provide clearance for the loading caddy 14.

Figure 3:
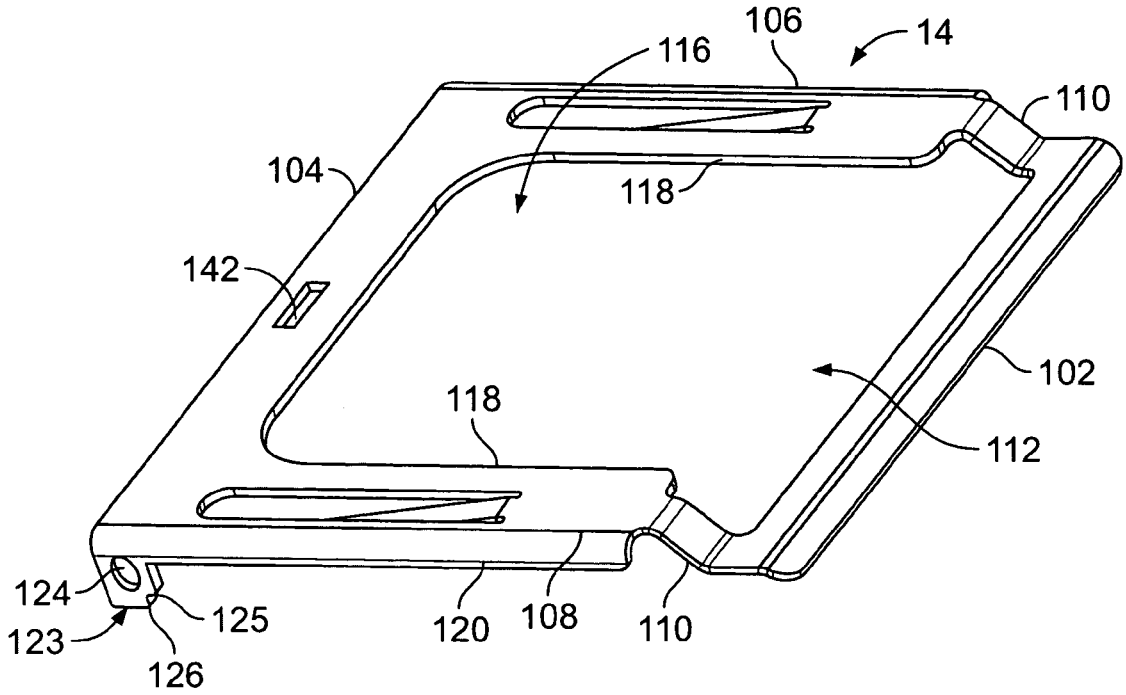
FIG. 3 is a top perspective view of the loading caddy of the connector shown in FIG. 1.
Figure 6:
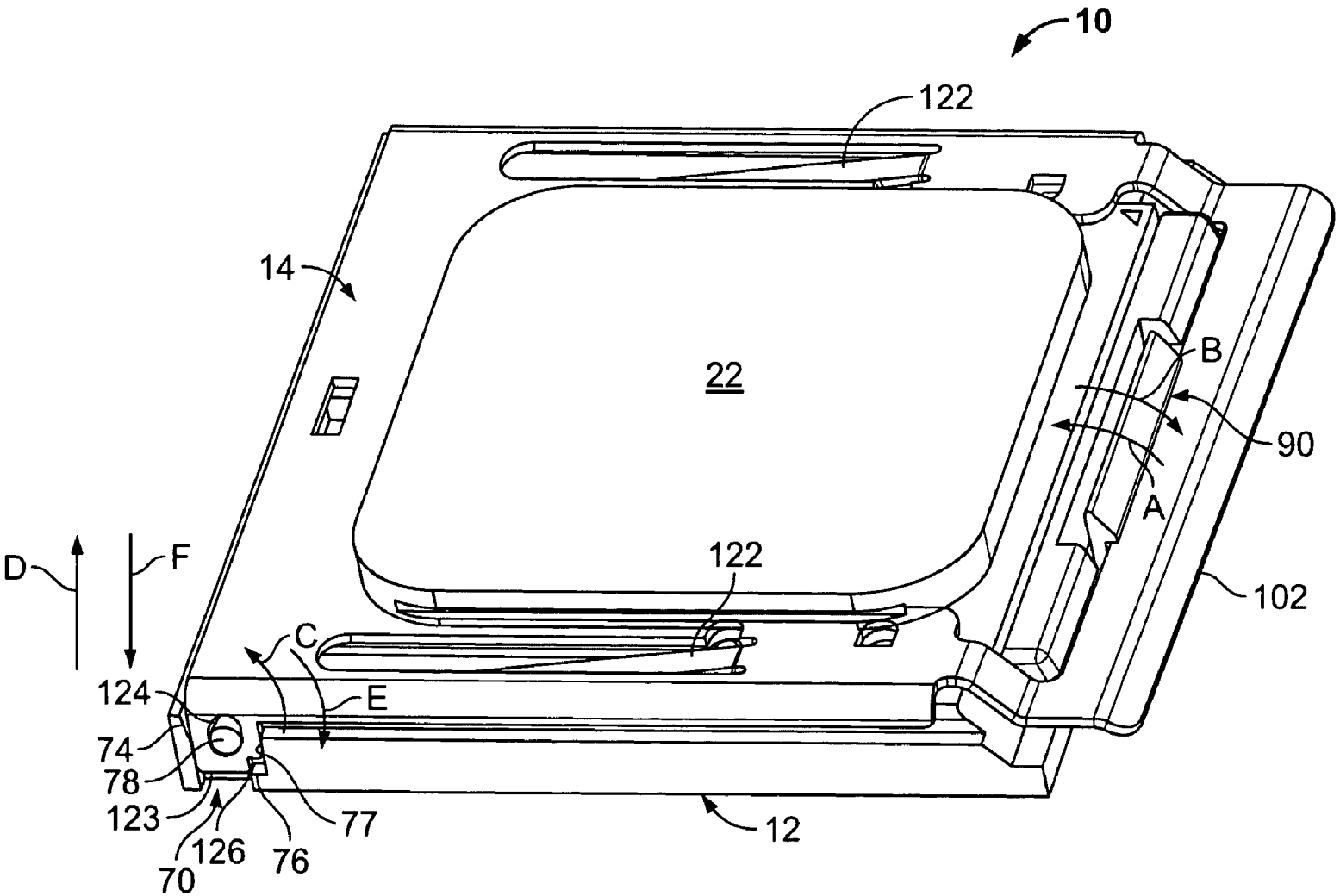
FIG. 6 is a perspective view of the connector shown in FIG. 1 in a closed position.

FIG. 3 illustrates a top perspective view of the loading caddy 14. The loading caddy 14 includes forward and rearward frame members 102 and 104 respectively, and opposed side members 106 and 108 all formed integral with one another. Angled tabs 110 connect the forward frame member 102 to the side members 106 and 108 such that the forward frame member 102 lies in a plane that is vertically displaced from a plane containing the side and rearward frame members 106, 108 and 104, and to provide a forward facing opening 112. The opening 112 provides an insertion path for the electronic package 22 (shown in FIG. 1). The side and rearward frame members 106, 108, and 104 respectively, define and partially surround a central opening 116 that receives the electronic package 22. The side members 106 and 108 include interior lips or edges 118 that are received in grooves 119 (see FIG. 1) in the sides of the electronic package 22 to support the electronic package 22 as the electronic package 22 is inserted into the loading caddy 14. Side members 106 and 108 include downwardly curved outer edges 120 that engage the ledges 82 (see FIG. 2) of the housing 12 when the loading caddy 14 is closed (FIG. 6).

Figure 4:
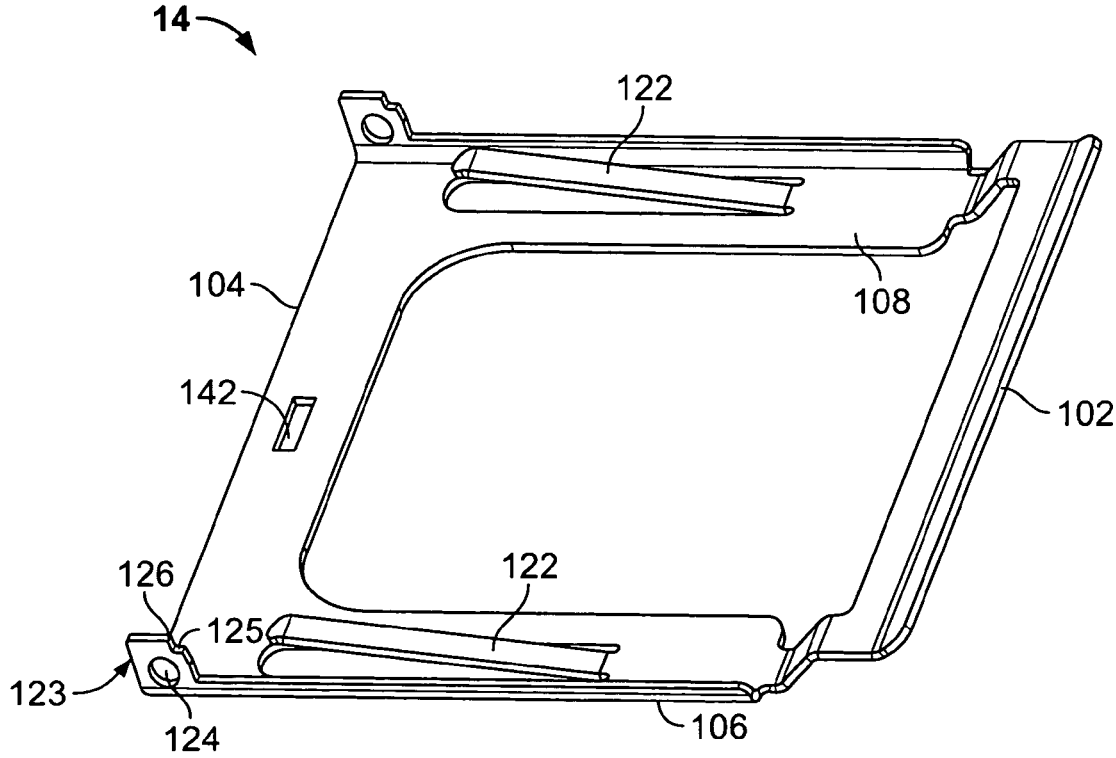
FIG. 4 is a bottom perspective view of the loading caddy shown in FIG. 3.

FIG. 4 illustrates a bottom perspective view of the loading caddy 14. Each side member 106 and 108 includes a spring finger 122 formed therein. The spring fingers 122 engage upper surfaces 85 on the housing side sections 44 and 46 (FIG. 2) to bias the loading caddy 14 upward toward an open position (FIG. 1).

With reference to FIGS. 3 and 4, the rearward frame member 104 includes connection elements in the form of mounting tabs 123 on opposite sides to mount the loading caddy 14 to the housing 12. The mounting tabs 123 are sized to be received in respective recesses 70 (see FIG. 2) provided in the housing 12. Each mounting tab 123 includes an elongated aperture 124 that receives the pivot post 78 and a stepped portion 125 that is complementary in shape to the stepped cutout 75 in the housing 12. Each mounting tab 123 has a bottom corner 126 below the step 125. The mounting tabs 123 cooperates with features in the recesses 70 so that the loading caddy 14 moves vertically (in the direction of arrow D in FIG. 1) and also rotates (in the direction of arrow C in FIG. 1) relative to the housing 12 as the loading caddy 14 is moved between an open position and a closed position as will be described in detail hereinafter.

Figure 5:
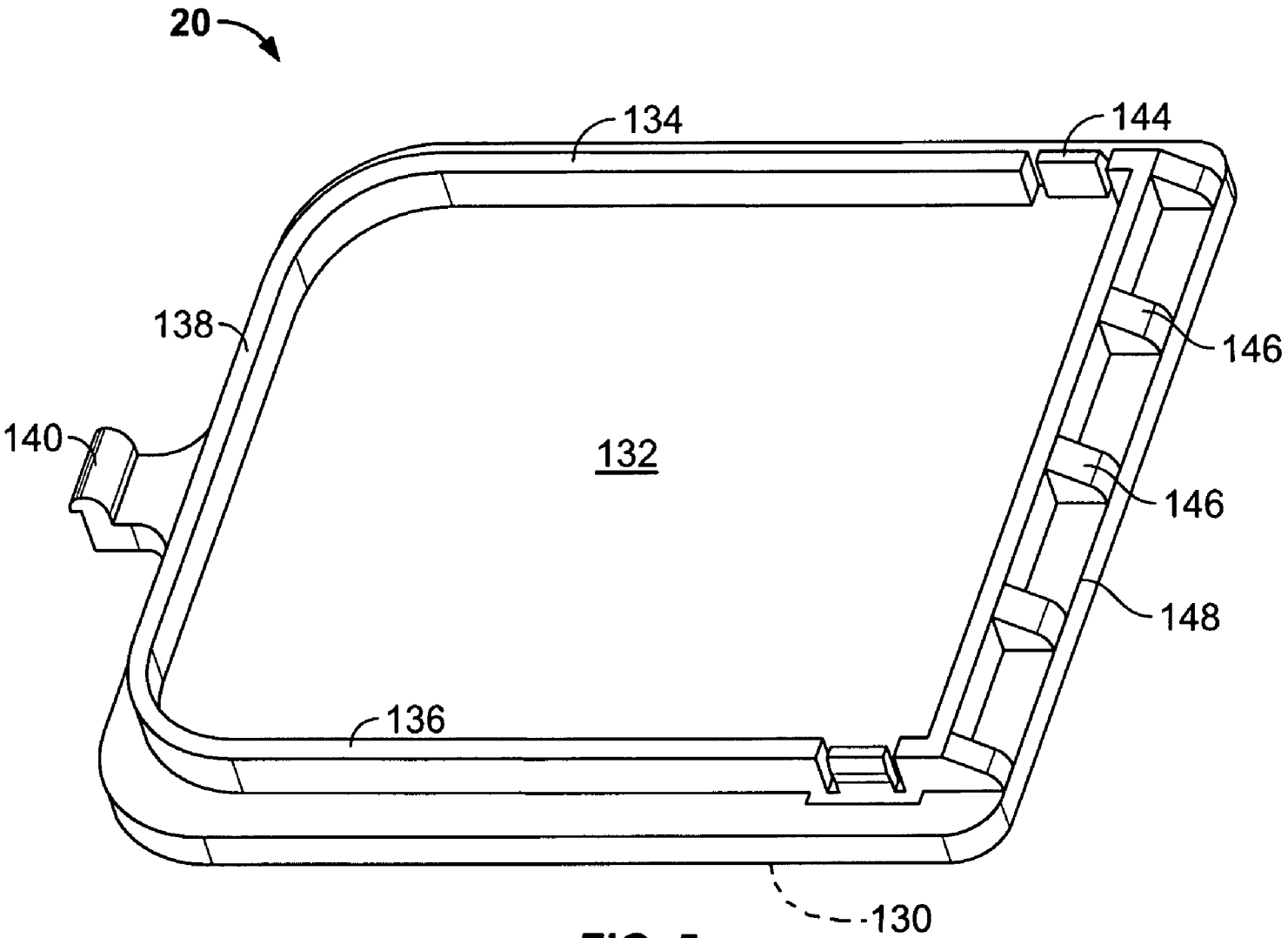
FIG. 5 is a bottom perspective view of the pick and place cover shown in FIG. 1.

FIG. 5 illustrates a bottom perspective view of the pick and place cover 20. The pick and place cover 20 is provided to cover the contact field 32 (FIG. 1) in the socket housing 12 when the electronic package 22 is not installed by preventing the entry of objects or materials into the socket housing 12. The pick and place cover 20, when present, is attached to the upper surface of the loading caddy 14 (FIG. 1). The pick and place cover 20 includes substantially planar upper and lower surfaces 130 and 132 respectively. Side walls 134 and 136 extend from the lower surface 132 and join an end wall 138 also extending from the lower surface 132. The side and end walls 134, 136, and 138 form a perimeter that is sized to be received in the opening 116 (FIG. 3) in the loading caddy 14. A hook 140 formed on a rearward portion of the pick and place cover 20 is received in an opening 142 in the loading caddy 14. A latch 144 formed on each side wall 134 and 136 snaps over the interior edge 118 of the side members 106 and 108 (FIG. 3) to hold the pick and place cover 20 in position on the loading caddy 14. A plurality of beveled projections or load ramps 146 extend across a forward facing edge 148 of the pick and place cover 20. In an alternative embodiment, a single load ramp 146 may extend continuously across the forward facing edge 148 of the pick and place cover 20.

The pick and place cover 20 is ejected from the loading caddy 14 when the electronic package 22 is inserted into the loading caddy 14. The electronic package 22 is slid into the loading caddy 14 through the opening 112 (see FIG. 3) in the direction of the arrow K (see FIG. 1). The electronic package 22 includes a leading edge 149 (see FIG. 1) that engages the load ramps 146 on the pick and place cover 20 as the package side grooves 119 receive the interior edges 118 of the loading caddy 14. The leading edge 149 forces the load ramps 146 and the pick and place cover 20 upward thereby dislodging and ejecting the pick and place cover from the loading caddy 14.

FIG. 6 is a perspective view of the connector 10 with the loading caddy 14 in a closed position. When closed, the forward frame member 102 of the loading caddy 14 is held by the latch member 90 on the housing 12. The mounting tab 123 on the loading caddy 14 is in a downward most position in the recess 70 (FIG. 2) in the housing 12. The spring fingers 122 are in contact with the side sections 44 and 46 (see FIG. 2) of the housing 12 biasing the loading caddy 14 upward toward an open position. The mounting tab 123 on the loading caddy 14 is in an upward most position in the recess 70 in the housing 12.

When the loading caddy 14 is in the closed position, the electronic package is aligned in the socket housing 12, however the spring fingers 122 maintains the loading caddy 14 in a position that is raised sufficiently such that no load or downward force is applied to the contact field 32 (FIG. 2) in the direction of the arrow F. Upon final assembly in an electronic device (not shown), a heat sink (not shown) is installed, along with its related hardware, which applies a load that moves the loading caddy 14 linearly and vertically to its downward most position in the recess 70, loading the electronic package 22 on to the contact array 36 (FIG. 2), and thereafter applies the mating force between the electronic package 22 and the contact array 36 in the contact field 32 (FIG. 2). When the heat sink is removed, the spring fingers 122 raise the loading caddy 14 to an upward most position in the recess 70 in the housing 12, and also raising the electronic package to a position wherein no load is applied to the contact field 32.

The movement of the loading caddy 14, when the heat sink is removed, will be described with reference to FIG. 6. The loading caddy 14 is biased in an upward position in the direction of the arrow D by the spring fingers 122. When the loading caddy 14 is raised in the direction of arrow D, the bottom corner 126 of the mounting tab 123 is located above or "clears" the step 76 and the loading caddy 14, when released, can be rotated in the direction of arrow C. To open the connector 10, from the closed position shown in FIG. 6, the loading caddy 14 is first released by movement of the latch element 90 in the direction of the arrow A. The bottom corner 126 on the mounting tab 123 clears the step 76 in the recess 70 and spring fingers 122 urge the loading caddy 14 to rotate in the direction of the arrow C. The range of rotation of the loading caddy 14 is indicated by the angle $\alpha$ (FIG. 1) and is limited by the engagement of the mounting tab 123 with the rearward beveled surface 74 and the vertical surface 77 in the recess 70. In an exemplary embodiment, the rotational movement of the loading caddy 14 is limited to about seven to ten degrees which is sufficient for removal of the electronic package.

Closure of the loading caddy 14 is accomplished by first rotating the loading caddy 14 in the direction of the arrow E until the mounting tab 123 is aligned in the recess 70. Rotation of the loading caddy 14 aligns the electronic package for placement on the contact field 32 (FIG. 2) in the housing. The mounting tab 123 remains in the upward most position in the recess 70 as continued pressure on the loading caddy 14 rotates the loading caddy 14 downward sufficiently for the forward frame 102 to engage the latch element 90. The forward frame 102 engages the latch element 90 moving the latch element 90 in the direction of the arrow A, after which the latch element 90 returns in the direction of the arrow B to latch the loading caddy 14 in the closed position.

The mounting tabs 123, recess 70 and posts 78 cooperate to provide linear vertical motion and rotation of the loading caddy 14 relative to the housing 12.

Figure 7:
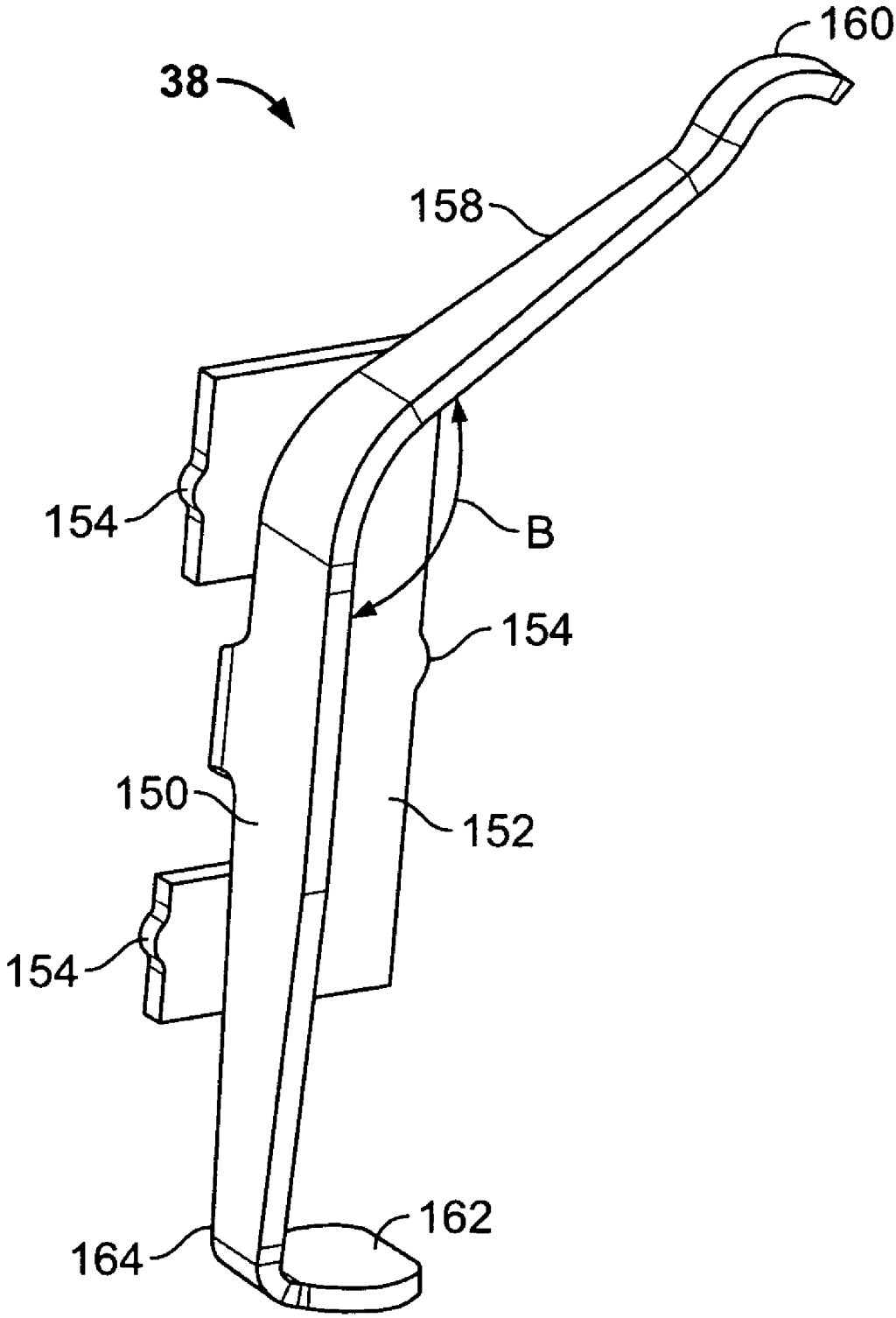
FIG. 7 is a perspective view of an electrical contact for the connector shown in FIG. 1.

FIG. 7 illustrates a perspective view of an exemplary electrical contact 38 for the connector 10. The contact 38 includes an elongated contact body 150 that is attached to and formed at a substantially right angle with an insertion plate 152. The insertion plate 152 is substantially rectangular in shape and includes retention bumps 154 that hold the contact 38 in the socket housing base 30 (see FIG. 2). A contact beam 158 extends upwardly from the body 150 at an obtuse angle $\beta$ and culminates in a curved contact tip 160 that mates with a pad (not shown) on the electronic package 22 (see FIG. 1). A solder ball paddle 162 is formed at a lower end 164 of the contact body 150. A solder ball (not shown) is placed on the underside of the solder ball paddle 162. The contact 38 is electrically and mechanically attached to the circuit board 26 (see FIG. 1) by conventional techniques such as reflow soldering.

In an exemplary embodiment, the socket connector 10 is an LGA connector. In use in the LGA connector 10, the contact 38 is subjected to a vertical or normal load to insure proper mating of the contact 38 with the LGA package. In response to the normal load, the contact 38 is designed so that the contact beam 158 deflects with respect to the contact body 150.

Figure 8:
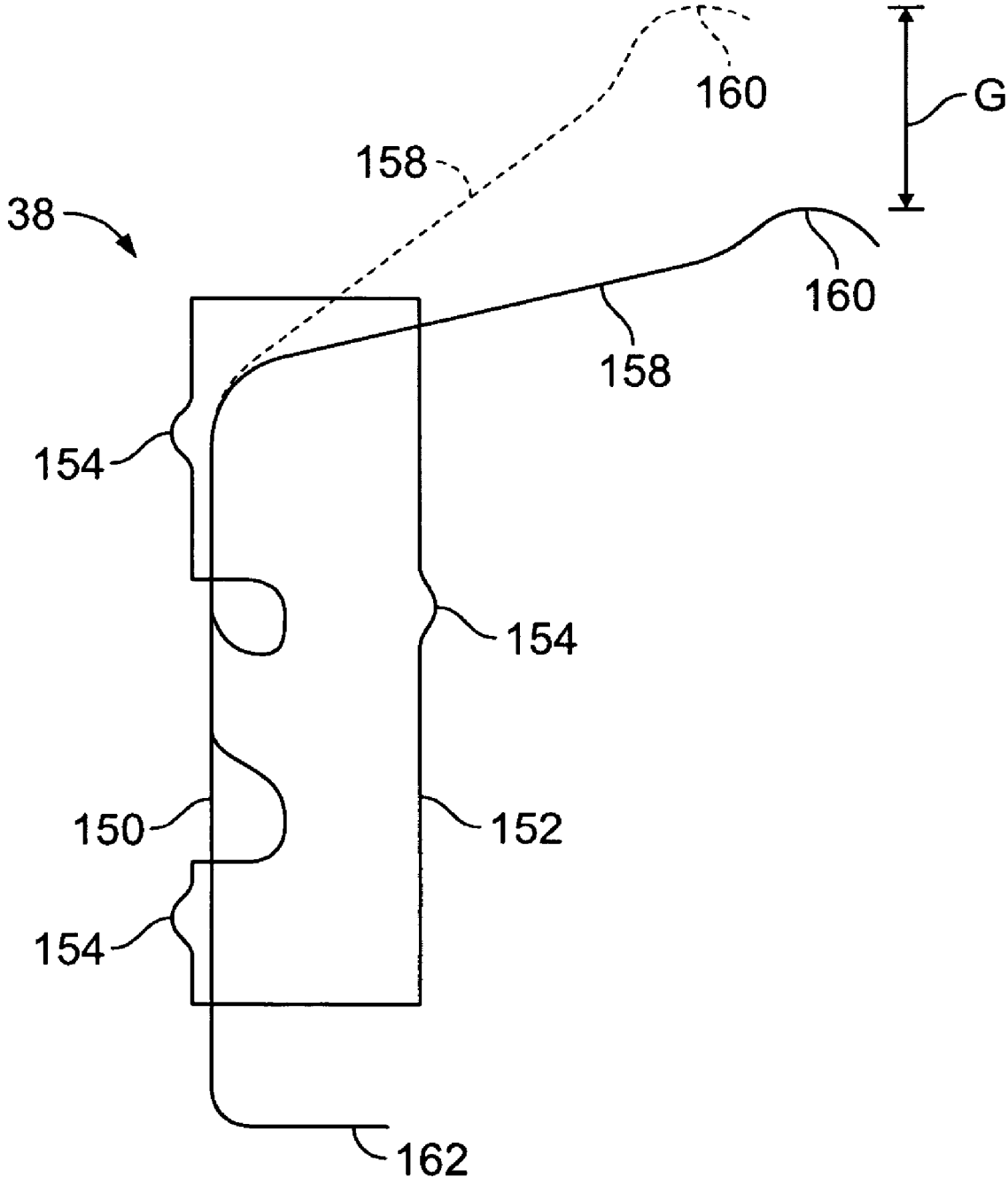
FIG. 8 is a schematic view of the contact shown in FIG. 7 illustrating the deflection of the contact beam under load.

FIG. 8 illustrates the deflection of the contact 38 when placed under a normal load. In FIG. 8, the contact beam 158 is shown in a free state in dashed outline, and in a deflected state in the solid outline. In the exemplary embodiment, the deflection G of the arm 158 is about 0.7 millimeters.

Figure 9:
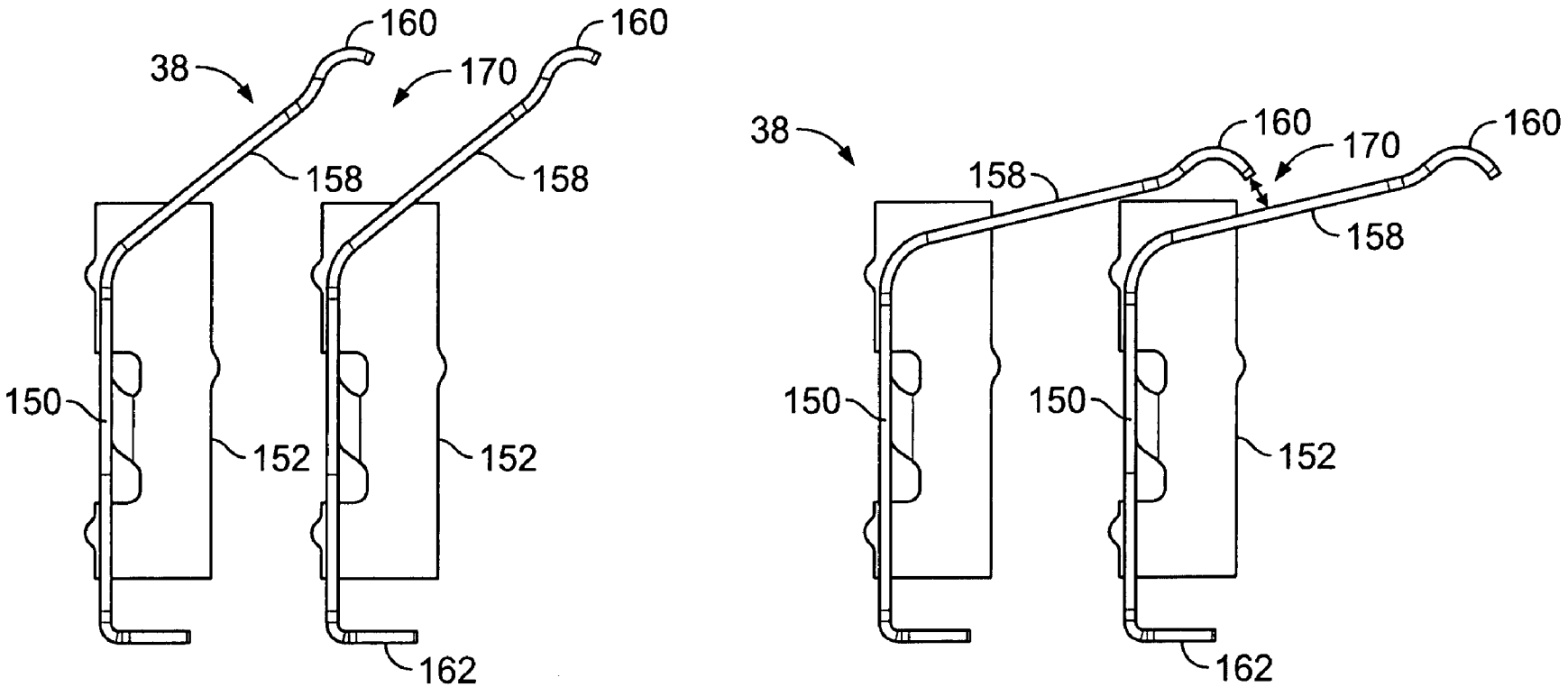
FIG. 9 is a side schematic view of the contact shown in FIG. 7 illustrating the deflection of a contact pair under load.

FIG. 9 illustrates the deflection of a pair of contacts 38 as would occur when the contacts 38 are installed in an array in the housing 12 at a contact spacing of about 1.55 millimeters. As shown in FIG. 9, as the contacts 38 deflect from the application of a normal load, a gap 170 between adjacent contacts 38 is reduced. In the exemplary embodiment, the gap 170 is about 0.19 millimeters when the deflection of the contact beams is about 0.7 millimeters.

Figure 10:
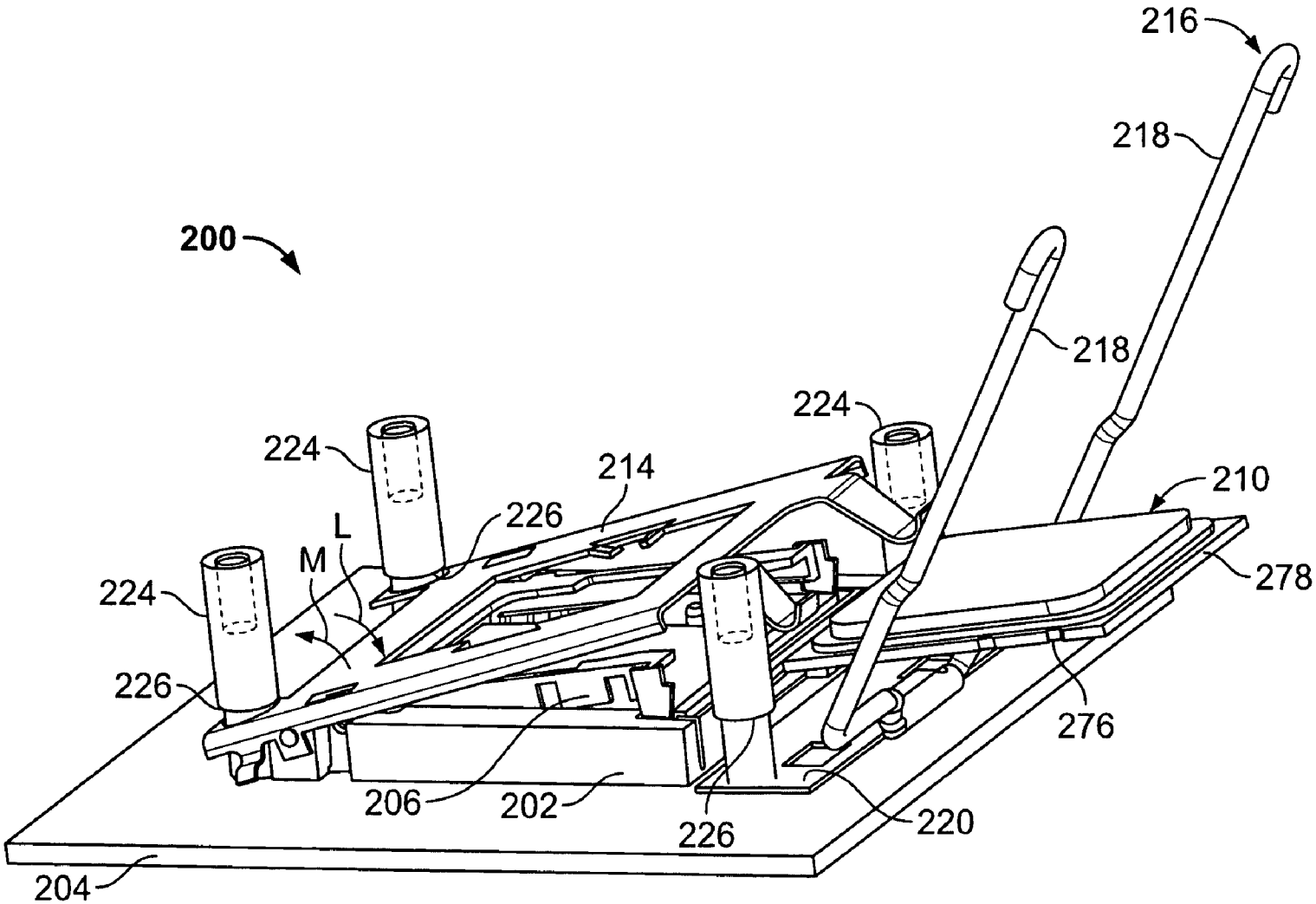
FIG. 10 is a perspective view of a socket connector formed in accordance with an alternative embodiment of the present invention.

FIG. 10 is a perspective view of a socket connector 200 formed in accordance with an alternative embodiment of the present invention. The socket connector 200 includes a housing 202 that is configured to be mounted on a circuit board 204. A loading caddy 206 is coupled to the housing 202 and is configured to rotate in the direction of the arrows L and M and also to translate vertically upward and downward to move between an open position wherein the loading caddy 206 can receive an electronic package 210 and a closed position within the housing 202 wherein the electronic package 210 is loaded into the housing 202. A load plate 214 is also coupled to the housing 202 and is also rotatable in the directions of the arrows L and M to move between an open position and a closed position. The load plate 214 is positioned above the loading caddy 206 and is structured to apply a preliminary load to the electronic package 210 when the load plate 214 is in the closed position. A locking lever 216 is rotatably coupled to a base plate 220. The locking lever 216 includes locking arms 218 that hold and release the load plate 214. Heat sink posts or standoffs 224 are provided to facilitate the installation of a heat sink (not shown) to absorb heat from the electronic package 210. The heat sink, when installed, provides the desired operating load to the electronic package 210. Each heat sink post includes a step 226. The load plate 214 engages the step 226 in the rearward heat sink posts when the load plate 214 is in an open position.

Figure 11:
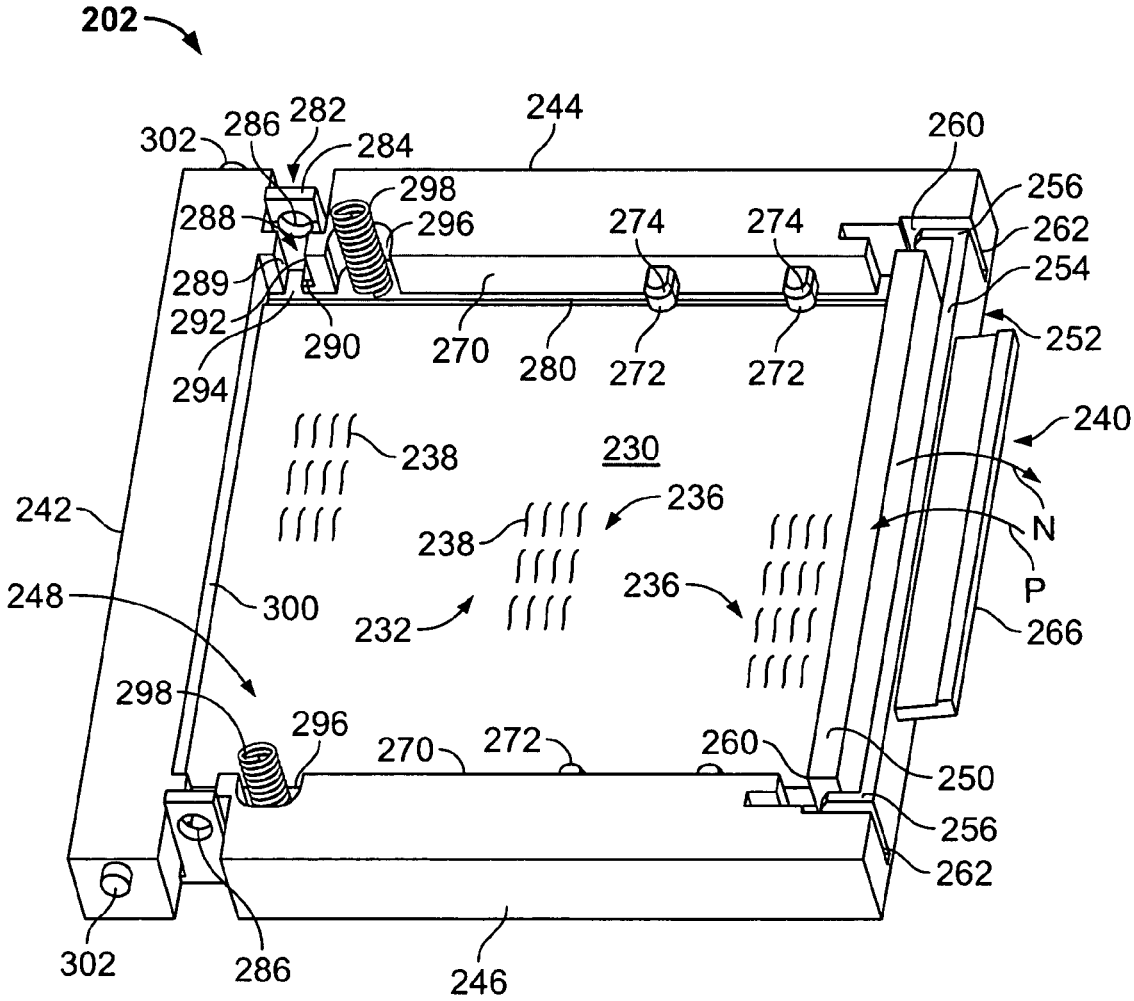
FIG. 11 is a perspective view of the housing of the connector shown in FIG. 10.

FIG. 11 illustrates a perspective view of the housing 202. The housing 202 includes a base 230 which is fabricated from a dielectric material and defines a contact field 232 that includes an array 236 of individual electrical contacts 238. The housing 202 includes a forward end 240, a rearward end 242, and opposite sides 244 and 246 that extend above the base 230 to define an enclosure 248 that receives the electronic package 210 and the loading caddy 206 (FIG. 10).

The forward end 240 includes an interior wall 250 and a latch member 252 formed in forward end 240. The latch member 252 engages the loading caddy 206 to retain the loading caddy 206 in a closed position. The latch member 252 includes a latch panel 254 that extends partially across the forward end 240. The latch panel 254 has a latch arm 256 at each end that is received in channels 260 formed in the forward end 240. Each latch arm 256 includes a latch finger (not shown) at an end thereof that engages a latch surface 334 on the loading caddy 206 (see FIG. 12) to hold the loading caddy 206 in a closed position. The latch panel 254 is formed between slots 262 formed in the forward 240 that provide a living hinge at the base of the slots 262 that allow rotational movement of the latch panel 254 in the direction of the arrows N and P with the latch panel being biased in the direction of the arrow P. A latch lever 266 is provided to operate the latch member 252. The latch panel 254 is rotated in the direction of the arrow N to release the loading caddy 206.

Each side 244 and 246 includes an interior wall 270 that include keys 272 to assure that the electronic package 210 is properly oriented with respect to the housing 202. Each key 272 includes a beveled guide surface 274 to guide the electronic package into the housing 202. Corresponding key slots 276 are provided on the base 278 of the electronic package 210 (see FIG. 10). A lower portion 280 of the interior side walls 270 is undercut to provide a clearance for package support legs on the loading caddy (see FIG. 12).

A mounting receptacle 282 is provided in each side 244 and 246 proximate the rearward end 242 for coupling the loading caddy 206 to the housing 202. The mounting receptacle 282 includes a pivot flange 284 that defines an aperture 286 for rotational attachment of the loading caddy 206 to the housing 202. The aperture 286 is elongated in a vertical direction to also provide a range of vertical movement for the loading caddy 206 when the loading caddy 206 is mounted in the housing 202. A stepped channel or recess 288 is formed in the sides 244 and 246 on an interior side of the pivot flange 284. The channel 288 has a substantially planar rear channel wall 289. A step 290 is formed in a forward channel wall 292 with a narrowed gap 294 extending below the step 290. The stepped channel 288 receives a correspondingly shaped feature on the loading caddy 206 as will be described. Each side 244 and 246 also includes a pocket 296 forward of the mounting receptacle 282 that receives a biasing member 298 that biases the loading caddy 206 toward an open position. In one embodiment the biasing member 298 is a coil spring.

The housing rearward end 242 includes a forward facing surface 300 that forms a rearward interior wall of the enclosure 248. A mounting post 302 extends laterally from each end of the housing rearward end 242. The mounting posts 302 are provided for rotational attachment of the load plate 214 to the housing 202.

Figure 12:
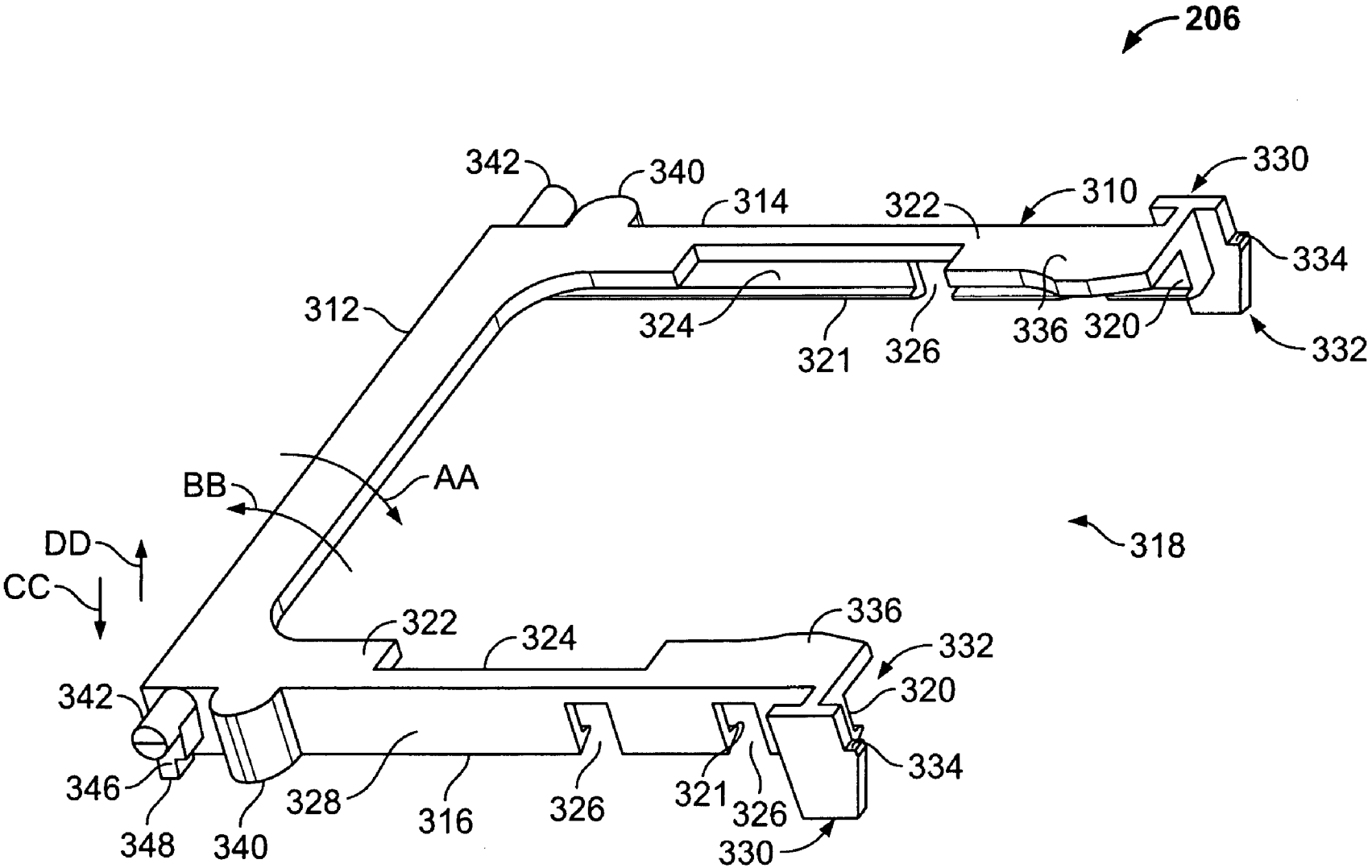
FIG. 12 a perspective view of the loading caddy of the connector shown in FIG. 10.

FIG. 12 illustrates a perspective view of the loading caddy 206. The loading caddy 206 includes a frame 310 that includes a rear section 312, opposite side members 314 and 316 and an open front 318. Each side member 314 and 316 includes a slot 320 that receives the electronic package 210 (FIG. 1). The slot 320 define a lip 321 that supports the electronic package 210 (FIG. 1). The slots 320 are located below a planar upper surface 322 of each side member 314 and 316. Cutouts 324 are centrally located and are formed in the upper surface 322 to provide an opening for biasing members 372 on the load plate 214 (see FIG. 13) to engage the electronic package. Relief slots 326 are formed in side panels 328 of the side members 314 and 316 to provide clearance for the keys 272 (FIG. 11) in the housing 202 (FIG. 11).

The side members 314 and 316 each includes a T-shaped tab 330 at a forward end 332 thereof. Each tab 330 includes a latch surface 334. The tabs 330 are received in the channels 260 (FIG. 11) in the housing 202 (FIG. 11) when the loading caddy 206 is in the closed position. The latch arms 256 (FIG. 11) of the latch member 252 (FIG. 11) engage the latch surfaces 334 to hold the loading caddy 206 in the closed position. The upper surface 322 of the side members 314 and 316 includes a package retention tab 336 that extends inwardly from the forward ends 332 of the side members 314 and 316. The package retention tabs 336 bear downward on a top surface of the electronic package 210 (FIG. 10) when the electronic package 210 is loaded into the loading caddy 206. The electronic package 210 snaps past the package retention tabs 336 when fully inserted into the loading caddy 206. The package retention tabs 336 then hold the electronic package 210 in place in the loading caddy 206. Each side member 314 and 316 includes a pocket 340 to retain the biasing member 298 that biases the loading caddy 206 toward an open position.

A pivot post 342 extends laterally from each end of the rear section 312 of the loading caddy 206. Each pivot post 342 includes a stepped tab 346 that has an extension 348. The stepped tab 346 is received in the stepped channel 286 (FIG. 11) in the housing 202 (FIG. 11). When installed in the housing 202, the pivot posts 342 are received in the elongated aperture 286 in the pivot flanges 284 on the housing 202. When the pivot posts 342 are positioned at the upper end of the elongated aperture 286 (FIG. 11), the extension 348 on the stepped tab 346 is above the step 290 (FIG. 11) in the channel 288 (FIG. 11) such that the loading caddy 206 is rotatable in the housing 202 downwardly in the direction of the arrow AA and upwardly in the direction of the arrow BB. Upward rotation of the loading caddy 206 is limited by interference with the load plate 214 (FIG. 10) which is positioned above the loading caddy 206. The extension 348 on the stepped tab 346 engages the rearward channel wall 289 (FIG. 11) in the housing 202 (FIG. 11) to limit downward rotation of the loading caddy 206 toward the closed position. When the downward rotation limit is reached, the loading caddy 206 is positioned so that the extension 348 on the stepped tab 346 is receivable in the gap 294 (FIG. 11) in the housing 202. In this position, the loading caddy 206 is movable vertically downward in the direction of the arrow CC to allow the loading caddy 206 to be closed and latched. When moved to the closed position, the loading caddy 206 is moved vertically downward so that the tab extension 348 (FIG. 11) is received in the gap 294 (FIG. 11) below the step 290 (FIG. 11) in the housing 202 (FIG. 11). The vertical downward movement of the loading caddy 206 loads the electronic package 210 (FIG. 10) into the housing 202. When moved sufficiently downward, the loading caddy 206 is held in place by the latch member 252 (FIG. 11). Similarly, when the latch member 252 is operated to release the loading caddy 206, the loading caddy 206 is first moved upward in the direction of the arrow DD by the biasing member 298 and is then rotatable in the direction of the arrow BB to an open position. In one embodiment, the tab extension 348 is configured to engage the forward channel wall 292 (FIG. 11) to limit a range of opening of the loading caddy 206.

Figure 13:
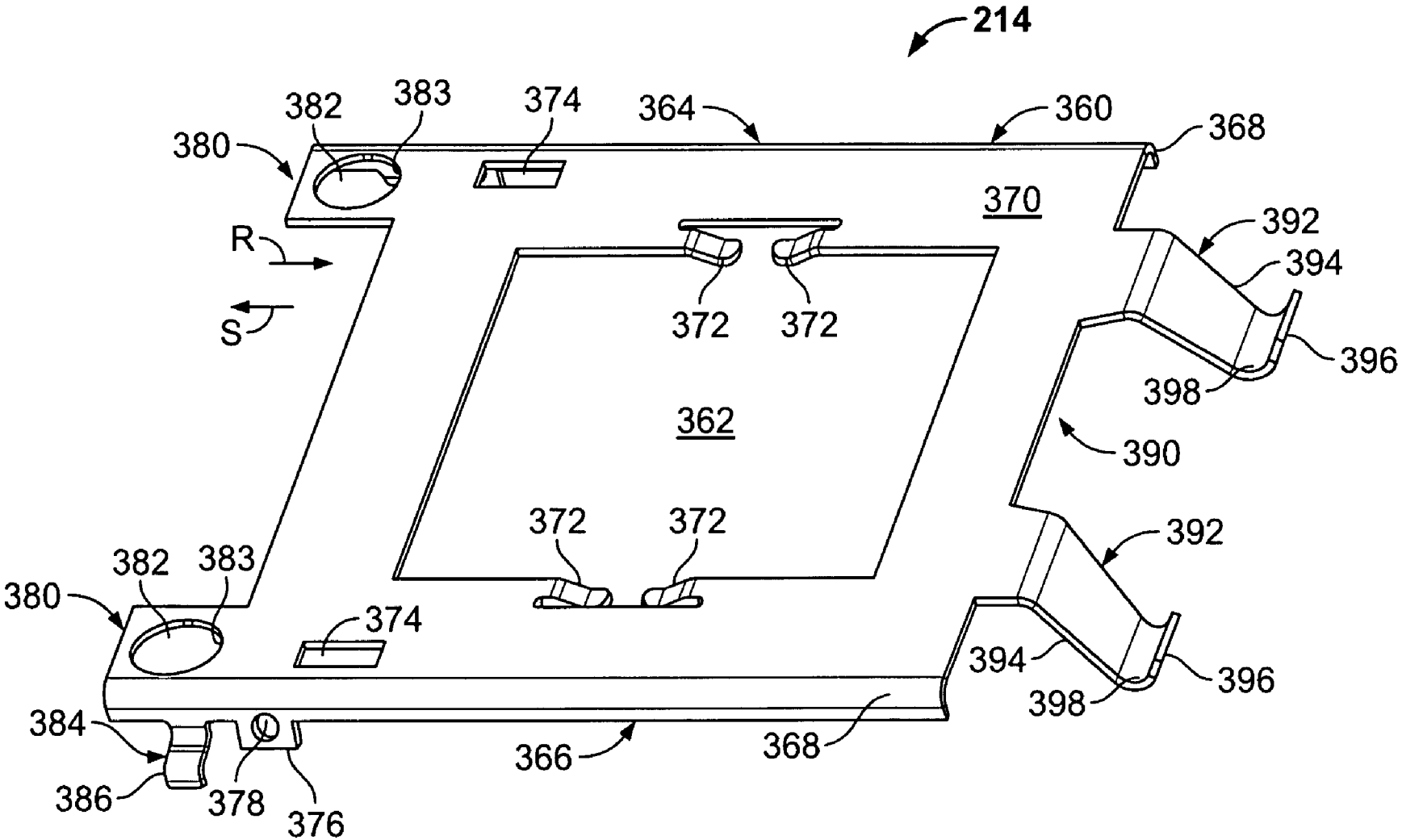
FIG. 13 is a perspective view of the load plate of the connector shown in FIG. 10.

FIG. 13 is a perspective view of the load plate 214. The load plate 214 is pivotably coupled to the housing 202 (FIG. 11) and rotatable between an open position and a closed position. In an exemplary embodiment, the load plate 214 is fabricated from metal and is substantially rectangular in shape. The load plate 214 includes a frame 360 defining a central opening 362 therein and having opposite sides 364 and 366. Each side 364 and 366 includes a curved edge 368. The load plate 214 includes a substantially planar top surface 370. Each side 364 and 366 includes biasing members 372 that engage the electronic package 210 (FIG. 10) through the cutouts 324 (FIG. 12) in the loading caddy 206 (FIG. 12) to impart a pre-load to the electronic package 210. The pre-load assures that the electronic package 210 (FIG. 10) remains properly positioned until a heat sink (not shown) is installed and provides the final mating force to fully deflect the contact beams 158 (FIG. 7). In an exemplary embodiment, the biasing members 372 comprise spring fingers formed in the sides 364 and 366. The spring fingers 372 extend downwardly from the top surface 370 of the load plate 214. Each side 364 and 366 also includes a relief slot 374 that receives an upper end of the pivot flanges 284 (FIG. 11) on the housing 202 (FIG. 11) when the load plate 214 is moved to a closed position.

The curved edges 368 each includes a mounting tab 376 extending downwardly therefrom. The mounting tabs 376 each includes an aperture 378 that receives one of the mounting posts 302 (FIG. 11) on the housing 202 (FIG. 11) for rotational attachment of the load plate 214 to the housing 202. The sides 364 and 366 each also includes rearward extensions 380, each of which includes a relief hole 382 for the heat sink posts 224 (FIG. 10). The relief holes 382 are elongated in the forward and rearward directions as indicated by the arrows R and S, respectively, to provide clearance to accommodate the rotation of the load plate 214. The heat sink posts 224 engage a forward edge 383 of the elongated opening of the relief holes 382 to limit the degree of opening of the load plate 214. In one embodiment, the load plate 214, when in the open position, also limits the degree of opening of the loading caddy 206 (FIG. 12).

Hold downs 384 extend from the curved edges 368 of the sides 364 and 366. The hold downs 384 include a latching legs 386 that receive the locking arms 218 (FIG. 10) of the locking lever 216 (FIG. 10) when the locking lever 216 is positioned to lock or hold the load plate 214 in the closed position.

The load plate 214 includes a forward end 390 from which a pair of locking fingers 392 extend. Each locking finger 392 includes an extension 394 that extends forwardly and downwardly from the forward end 390 and culminates in an upwardly curved end 396 that includes a cam surface 398. The cam surfaces 398 are engaged by the locking lever 216 (FIG. 10) to urge the load plate 214 into the closed position.

Figure 14:
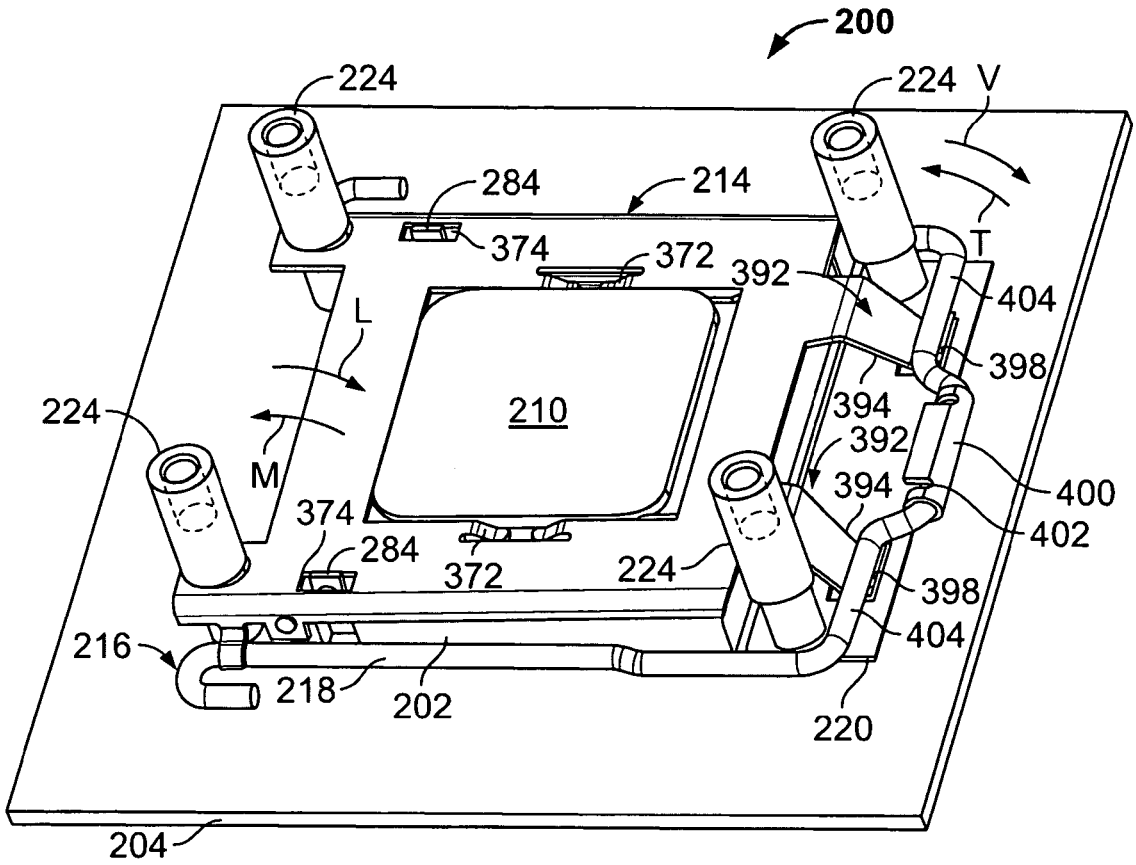
FIG. 14 is a perspective view of the connector shown in FIG. 10 in a closed position.

FIG. 14 is a perspective view of the connector 200 in a closed position. The electronic package 210 is loaded in the loading caddy 206 (FIG. 12). The loading caddy 206, due to its position relative to the load plate 214, is closed and latched to the housing 202 whenever the load plate 214 is closed and latched. The load plate 214 is latched in the closed position by the locking lever 216. The locking lever 216 is rotatably mounted to the base plate 220 at a pivot clamp 400. The locking lever 216 includes a pivot section 402 that is received in the pivot clamp 400 and is centrally positioned between the locking arms 218. Offset sections 404 interconnect the pivot section 402 and the locking arms 218. When the locking lever 216 is rotated downwardly in the direction of the arrow T, the offset sections 404 engage the cam surfaces 398 on the locking fingers 392 of the load plate 214 to urge the load plate 214 into the closed position. The locking lever 216 is maintained in the closed position by the latching legs 386 (FIG. 13) that receive the locking arms 218 of the locking lever 216. In the closed position, the pivot flanges 284 are received in the relief slots in the load plate 214. The spring fingers 372 extend through the cutouts 324 in the loading caddy 206 (FIG. 12) to apply a pre-load to the sides of the electronic package 210 to hold the electronic package 210 in position until a heat sink is installed. The locking lever 216 is rotatable in the direction of the arrow V to release the load plate 214 and allow the load plate 214 to be moved to the open position.

The embodiments thus described provide a socket connector that reduces the potential for damage to the contact field which is exposed when the electronic package is not installed. In one embodiment, the connector includes a pick and place cover that covers the contact field until the package is installed. A loading caddy receives the electronic package and aligns the package in the housing minimizing the potential for misalignment of the package. In this embodiment, no load is applied to the contact field prior to installation of a heat sink. The loading caddy is biased in the open position and the opening is limited to reduce the exposure of the contact field. In another embodiment, the connector further includes heat sink posts and a load plate. The load plate applies a pre-load to the electronic package to hold the electronic package in position until a heat sink is installed which provides the final loading on the package against the contact beams.

While the invention has been described in terms of various specific embodiments, those skilled in the art will recognize that the invention can be practiced with modification within the spirit and scope of the claims.

What is claimed is:

1. A socket connector for an electronic package, said connector comprising:

a housing; and a loading caddy having a forward end and a rearward end, said forward end including an opening dimensioned to receive the electronic package, said loading caddy being coupled to said housing for linear and rotational movement therewith, said loading caddy rotating through a first range of motion adapted to align the electronic package with respect to said housing, and descending linearly through a second range of motion to load the electronic package into said housing.

2. The socket connector of claim 1, wherein the electronic package includes a slot, said housing comprising a key to orient the electrode package relative to said housing via the slot.

3. The socket connector of claim 1, wherein said connector is an LGA socket connector.

4. The socket connector of claim 1, wherein said loading caddy includes opposite side members, each of said side members including a lip to support the electronic package when the electronic package is inserted into said loading caddy.

5. The socket connector of claim 1, wherein said housing includes a stepped recess and said loading caddy includes a stepped tab, said stepped tab received in said stepped recess to couple said loading caddy to said housing, said tab being movable through said first and second ranges of motion within said stepped recess.

6. The socket connector of claim 1 further comprising a load plate rotatably coupled to said housing, said load plate configured to apply a load to the electronic package.

7. The socket connector of claim 1 further comprising a load plate rotatably coupled to said housing and including an aperture, and a heat sink post extending through said aperture, said heat sink post being positioned to limit a range of rotation of said load plate.

8. The socket connector of claim 1 further comprising a load plate rotatably coupled to said housing, said load plate being positioned proximate said loading caddy such that said load plate limits a range of movement of said loading caddy.

9. The socket connector of claim 1 further comprising a load plate rotatably coupled to said housing and a base plate proximate a forward end of said housing, said base plate including a locking lever configured to engage said load pate to move said load plate to a closed position and retain said load plate in said closed position.

10. The socket connector of claim 1, wherein said loading caddy includes opposite side members, each said side member including a retention tab formed thereon to retain the electronic package.

11. The socket connector of claim 1 further comprising a pick and place cover releasably mounted on said loading caddy proximate said opening, said pick and place cover being located partially within said opening such that, when the electronic package is loaded into the loading caddy, the electronic package disengages said pick and place cover from said loading caddy.

12. A socket connector for an electronic package, said connector comprising:

a housing including a stepped recess; and a loading caddy coupled to said housing and movable between an open position and a closed position, said loading caddy being configured to receive an electronic package when in said open position and load the electronic package into said housing when moved to said closed position, said loading caddy including a frame member that engages said housing when in said closed position, said frame member having a stepped tab that extends downward from said frame member toward said housing and is received in said stepped recess, said tab and recess being rotatably coupled to one another to couple said loading caddy onto said housing, said tab being configured to engage a surface of said recess to limit a range of rotational movement of said loading caddy.

13. The socket connector of claim 12 further comprising a load plate, wherein said loading caddy is located between said load plate and said housing, said load plate including a second biasing member that applies a load to the electronic package through a cutout in said loading caddy.

14. The socket connector of claim 12, wherein said recess and tab include a pivot post and an elongated aperture that receives said pivot post, said pivot post sliding along, and rotating within, said aperture.

15. The socket connector of claim 12 further comprising a load plate rotatably coupled to said housing and including an aperture, and a heat sink post extending trough said aperture, said heat sink post being positioned to limit a range of rotation of said load plate.

16. The socket connector of claim 12, wherein said loading caddy includes opposite side members, each said side member including a retention tab formed thereon to retain the electronic package.

17. The socket connector of claim 12, wherein said recess includes a pivot post and said tab includes an elongated recess receiving said post.

18. A socket connector for an electronic package, said connector comprising:

a housing including a recess;

a loading caddy coupled to said housing and movable between an oven position and a closed position, said loading caddy being configured to receive an electronic package when in said open position and load the electronic package into said housing when moved to said closed position, said loading caddy including a tab that is received in said recess to couple said loading caddy onto said housing, said tab being configured to engage a surface of said recess to limit a range of rotational movement of said loading caddy; and a biasing member between said housing and said loading caddy, said biasing member biasing said loading caddy toward said open position.

19. A socket connector for an electronic package, said connector comprising:

a housing including a recess;

a loading caddy coupled to said housing and movable between an open position and a closed position, said loading caddy being configured to receive an electronic package when in said open position and load the electronic package into said housing when moved to said closed position, said loading caddy including a tab that is received in said recess to couple said loading caddy onto said housing, said tab being configured to engage a surface of said recess to limit a range of rotational movement of said loading caddy; and a pick and place cover releasably mounted on said loading caddy, said pick and place cover being located partially within said opening such that, when the electronic package is loaded into the loading caddy, the electronic package disengages said pick and place cover from said loading caddy.

20. A socket connector for an electronic package, said connector comprising:

a housing including a recess;

a loading caddy coupled to said housing and movable between an open position and a closed position, said loading caddy being configured to receive an electronic package when in said open position and load the electronic package into said housing when moved to said closed position, said loading caddy including a tab that is received in said recess to couple said loading caddy onto said housing, said tab being configured to engage a surface of said recess to limit a range of rotational movement of said loading caddy; and load plate rotatably coupled to said housing, said load plate being positioned proximate said loading caddy such that said load plate limits a range of movement of said loading caddy.

21. A socket connector for an electronic package, said connector comprising:

a housing;

an electronic package; and a loading caddy having a forward end and a rearward end, said forward end including an opening dimensioned to receive said electronic package, said loading caddy being coupled to said housing for linear and rotational movement therewith, said loading caddy rotating through a first range of motion adapted to align said electronic package with respect to said housing, and descending linearly through a second range of motion to load said electronic package into said housing.

* * * * *